US010357103B2

(12) United States Patent
Guzman

(10) Patent No.: US 10,357,103 B2
(45) Date of Patent: Jul. 23, 2019

(54) HEIGHT ADJUSTABLE DESK

(71) Applicant: Guadalupe Guzman, El Paso, TX (US)

(72) Inventor: Guadalupe Guzman, El Paso, TX (US)

( * ) Notice: Subject to any disclaimer, the term of this patent is extended or adjusted under 35 U.S.C. 154(b) by 0 days.

(21) Appl. No.: 15/891,103

(22) Filed: Feb. 7, 2018

(65) Prior Publication Data

US 2018/0228279 A1 Aug. 16, 2018

(30) Foreign Application Priority Data

Feb. 10, 2017 (TW) ..... 106201983 U
Feb. 20, 2017 (CN) ..... 2017 2 0150912 U

(51) Int. Cl.

| | |
|---|---|
| ***A47B 9/06*** | (2006.01) |
| ***A47B 9/14*** | (2006.01) |
| ***A47B 13/12*** | (2006.01) |
| ***A47B 21/02*** | (2006.01) |
| ***A47B 21/03*** | (2006.01) |

(52) U.S. Cl.

CPC ..... *A47B 21/02* (2013.01); *A47B 9/06* (2013.01); *A47B 9/14* (2013.01); *A47B 13/12* (2013.01); *A47B 21/0314* (2013.01); *A47B 2021/0364* (2013.01)

(58) Field of Classification Search

CPC .. A47B 21/02; A47B 9/00; A47B 9/04; A47B 9/06; A47B 9/08; A47B 9/14; A47B 2009/065; A47B 17/02; A47B 2021/0364

See application file for complete search history.

(56) References Cited

U.S. PATENT DOCUMENTS

| | | | | | |
|---|---|---|---|---|---|
| 3,525,442 | A * | 8/1970 | Novales | A47B 57/30 | 211/182 |
| 4,754,841 | A * | 7/1988 | Koffski | E06C 9/04 | 182/100 |
| 5,644,993 | A * | 7/1997 | Dohnalik | A47B 21/02 | 108/108 |
| 5,845,743 | A * | 12/1998 | Dechant | E04G 3/20 | 182/187 |
| 7,823,893 | B2 * | 11/2010 | Meyers | B62B 1/12 | 280/47.18 |
| 2012/0248263 | A1 * | 10/2012 | Grotenhuis | A47B 21/02 | 248/123.2 |
| 2013/0126682 | A1 * | 5/2013 | Tholkes | F16M 11/046 | 248/125.8 |
| 2017/0013957 | A1 * | 1/2017 | McRorie, III | A47B 21/02 | |
| 2017/0290417 | A1 * | 10/2017 | Cassamajor | A47B 19/00 | |
| 2018/0168334 | A1 * | 6/2018 | Swartz | F16M 13/00 | |

* cited by examiner

*Primary Examiner* — Daniel J Rohrhoff
(74) *Attorney, Agent, or Firm* — Schneider IP Law LLC; Laura Ann Schneider

(57) ABSTRACT

A height-adjustable desk has a base, having a support, a middle portion of a rear side of the support having a column disposed thereon and being upright, a front side of the column having a plurality of slots, the slots being spaced along the column. The desk has a shelf, having a frame, an upper desk top and a lower desk top, the frame disposed on and moveably surrounding the column, the frame having an insert corresponding to the slots, the insert configured to be inserted into one of the slots, the upper desk top located at the frame, the lower desk top located at the frame lower than the upper desk top.

9 Claims, 6 Drawing Sheets

HEIGHT ADJUSTABLE DESK

FIELD OF THE INVENTION

The present invention relates to a desk, and more particularly to a field of height adjustable desks.

BACKGROUND OF THE INVENTION

Since the era of computers becoming popular and the Internet being rapidly developed, the relationship between mankind and computer become more and more inseparable, both in life, learning or work, etc. Computers are widely used in daily life; however, health problems raise because people usually use and sit in front of the computer for a long time and some of them even sit in a bad posture. As a result, a wide range of height adjustable desks can be chosen in the current market, so that users can freely choose to stand or to sit in front of the computer by adjusting the height of the desk according to their own physical condition.

However, the structures of these conventional height adjustable desks are complex, resulting in high production costs, and so do the commodity prices. In addition, most of the height adjustment desks have only one desk top, which is mainly used to place the computer, keyboard and mouse. While the height of the desk top has been adjusted to meet the most appropriate reading height of the user's eyes, the user must raise his hands up to the height of the desk top in order to place them, and while this posture has been maintained for a period of time, excessive stress may apply on the user's shoulder that causes pain. On the other hand, if the height of the desk top has been adjusted to meet the most comfortable and natural height of the user's hands, the user has to stare down to see the screen. If the user stares down for a long period of time, consequently eye fatigues occur, and because the neck also bears with stress for a long time, stiff-neck or other severe harms might occur as well.

SUMMARY OF THE INVENTION

In order overcome drawbacks of conventional height-adjustable desks such as only having a single desk top and with overcomplex structures, a height-adjustable desk is provided in the present invention, the height-adjustable desk comprises:

a base, having a support, in which a middle portion of a rear side of the support has an upright column disposed thereon, a front side of the column has a plurality of slots, the slots are equally spaced along the column;

a shelf, having a frame, an upper desk top and a lower desk top, in which the frame is disposed on and surrounds the column, the frame has a front side and a rear side with front panel and a rear panel disposed thereon respectively, and has a left side and a right side with a left panel and a right panel disposed thereon respectively, the interval between the front panel and the rear panel is greater than the width between the front side and the rear side of the column, a rear side of the front panel of the frame, which is relative to the front side of the column, has an insert, an upper side of the insert is an cambered surface and a bottom side of the insert is a flat surface, the insert is configured to be inserted into one of the slots, the rear side of the front panel is configured to be attached to the front side of the column, the rear side of the column and a front side of the rear panel of the frame, which is relative to the rear side of the column, defines a gap, the front side of the rear panel of the frame has a spacer located within the gap and attached upper part of the front side of the rear panel, a bottom edge of a front side of the spacer forms a bevel, the location of the spacer is relatively higher than the insert, each of an upper part of the left panel and an upper part of the right panel of the frame has an extended arm extending toward the and being symmetrical to each other, each of a bottom of the left panel and a bottom of the right panel has a support arm extending toward the front. The upper desk top is located at the front of an upper part of the frame, the upper desk top is placed on two respective upper surfaces of the two extending arms, the lower desk top is located at the front of a lower part of the frame, and the lower desk top is placed on two respective upper surfaces of the two support arms.

While in use of the present invention, the user applies force to the lower table in a parallel direction toward the user himself, the shelf moves forward relative to the column, and with respect to the front side of the column, the front panel of the frame moves forward away from the front side of the column, the insert moves forward as well but still remains in the slot, the spacer of the rear panel moves forward relative to the rear side of the column and abuts against the rear side of the column so as to be a pivot while the frame moves. By using the spacer as a pivot, the way the user applies force to the shelf is restrained; the user applies force to the lower desk top upwardly and in a direction toward the user himself, the lower desk top then slightly swings forward and upwardly, driving the bottom of the frame to be slightly swung forward and upwardly as well, as the top end of the rear panel does not move with respect to the rear side of the column due to the spacer disposed there as a pivot, the rest of the part of the rear panel except the vicinity around the top end swings forward and upwardly within the gap, the bottom edge of the rear panel abuts against the rear side of the column, the insert on the front panel moves forward and upwardly and finally releases from the slot.

At that time, the shelf can be freely moved up or down. While the user applies force to the lower desk top upwardly, the shelf may be slid upwardly along the column to one of the slots located at the ideal height determined by the user. Next, the user may apply force to the lower desk top in a parallel direction away from the user himself. As a result, the shelf moves backward with respect to the column, the front panel moves backward with respect to the front side of the column, the rear side of the front panel will then be attached to the front side of the column, the insert of the front panel moves backward, the insert embeds into the slot, the spacer of the rear panel moves away from the rear side of the column, the gap between the front side of the rear panel and the rear side of the column returns to normal, and the shelf is finally rested on the base.

The advantages of the present invention include the followings:

1. The structure of the present invention is concise, in which only the base and the shelf is needed to form the height adjustable desk, and with respect to the manufacturing costs, the present invention is much lower than the conventional ones.

2. The upper desk top and the lower desk top of the present invention provide ergonomic heights, in which the upper desk top is used to place a computer screen, whereas the lower desk top is used to place the keyboard and the mouse, the height of the upper desk top provides the user to watch the computer screen in a flat angle with the user's eyes, so that the user's neck can be in a natural posture, and because the height of the lower desk top is the same as that of the user's hands in a natural posture while using the keyboard and the mouse, the users shoulder is naturally positioned.

3. The designed shapes of the spacer of the frame and the insert allow the user to utilize the height adjustable desk safely. If the user pulls out the insert from the slot and accidentally looses his hands while lifting the height adjustable desk, the height adjustable desk will not fall due to the cambered structures of the bottom edge of the spacer of the frame, and the upper edge of the insert; the down forces applied by the frame and the desks drives the insert into one of the slots immediately in a rotation, a swinging manner.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
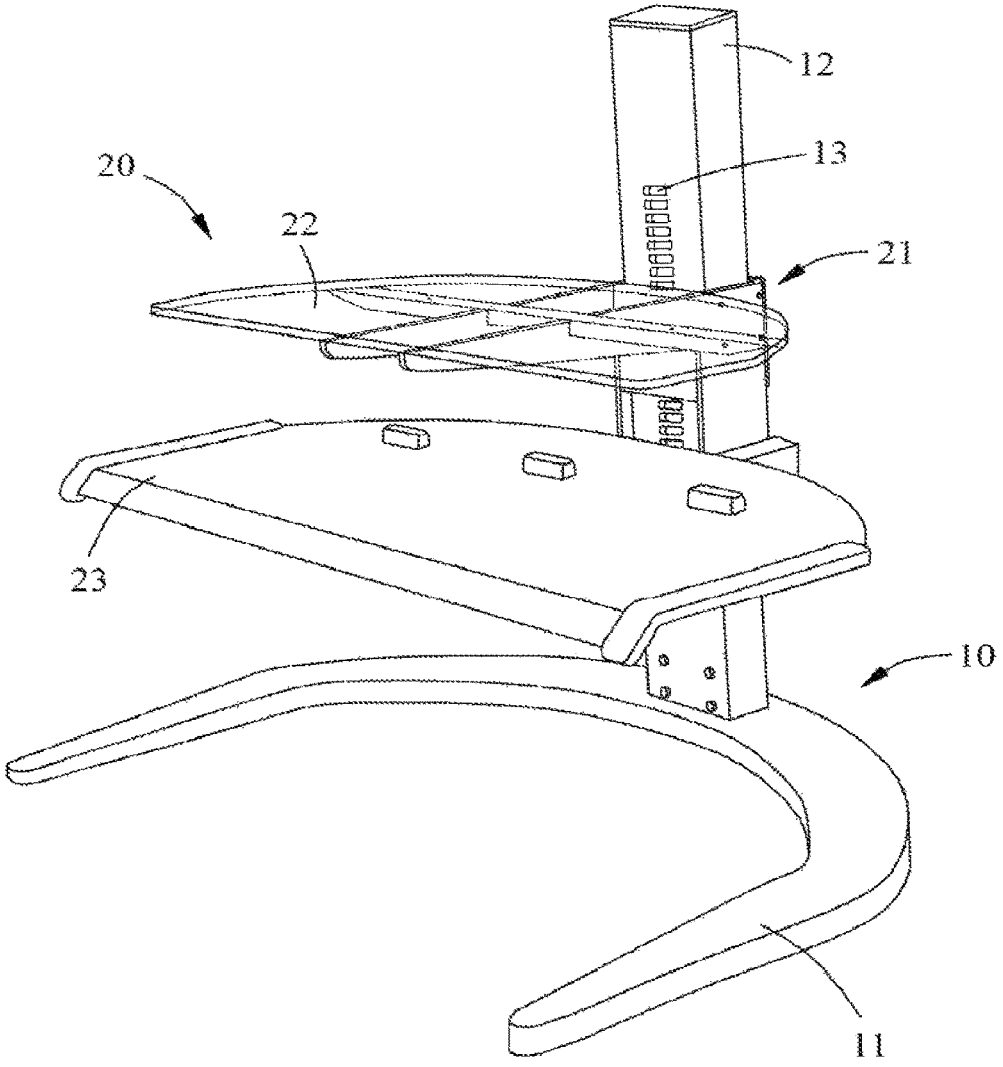
FIG. 1 is a front perspective view illustrating a first preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts. It is not intended to limit the structures by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having" and the like are to be understood to be open-ended, i.e., to mean including but not limited to. As used in the description herein and throughout the claims that follow, the meaning of "in" includes "in" and "on" unless the context clearly dictates otherwise.

It will be understood that when an element is referred to as being "connected" to another element, it can be directly connected to the other element or intervening elements may be present.

A height adjustable desk is provided according to a first preferred embodiment of the present invention, as shown in FIG. 1, the height adjustable desk includes a base 10 and a shelf 20.

Referring to FIG. 1, the base 10 includes a support 11 and a column 12, the support 11 is in a U-shape, the column 12 is disposed upright and at the middle of a rear side of the support 11, for keeping the height adjustable desk balanced. The column 12 is a square column and is hollow, a front side of the column 12 has a number of slots 13, and the slots 13 are equally spaced along the column 12.

Figure 2:
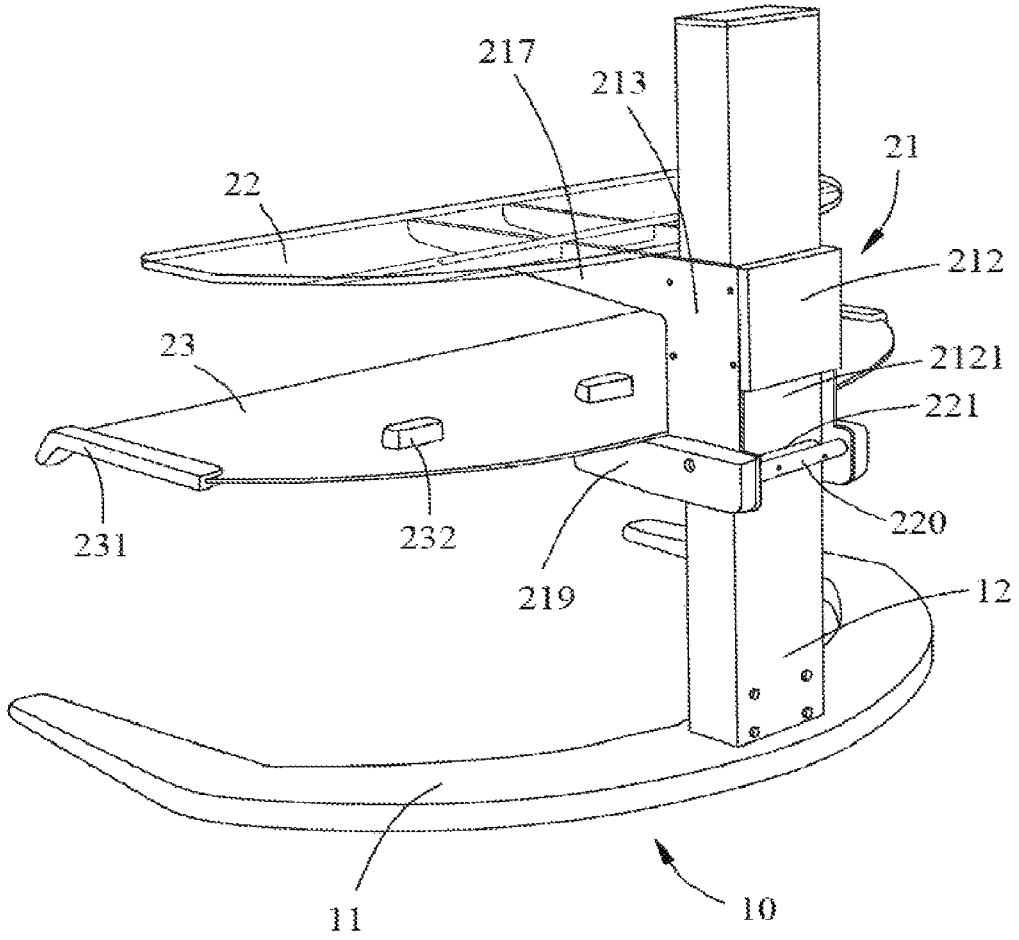
FIG. 2 is a rear perspective view illustrating the first preferred embodiment of the present invention.

As shown in FIG. 2, the shelf 20 includes a frame 21, an upper desk top 22 and a lower desk top 23, the frame 21 is disposed on and surrounding the column 12, the frame 21 has a front panel 211, a rear panel 212, a left panel 213, and a right panel 214 disposed at its front side, rear side, left side and right side, respectively. The height of a bottom edge of the rear panel 212 is relatively higher than a bottom edge of the left panel 213 and a bottom edge of the right panel 214, such that an opening 2121 is formed at a lower part of the rear panel 212, the left panel 213 is fixed to the left side of the front panel 211 and the rear panel 212 by screws, and the right panel 214 is fixed to the right side of the front panel 211 and the rear panel 212 by screws as well.

Figure 3:
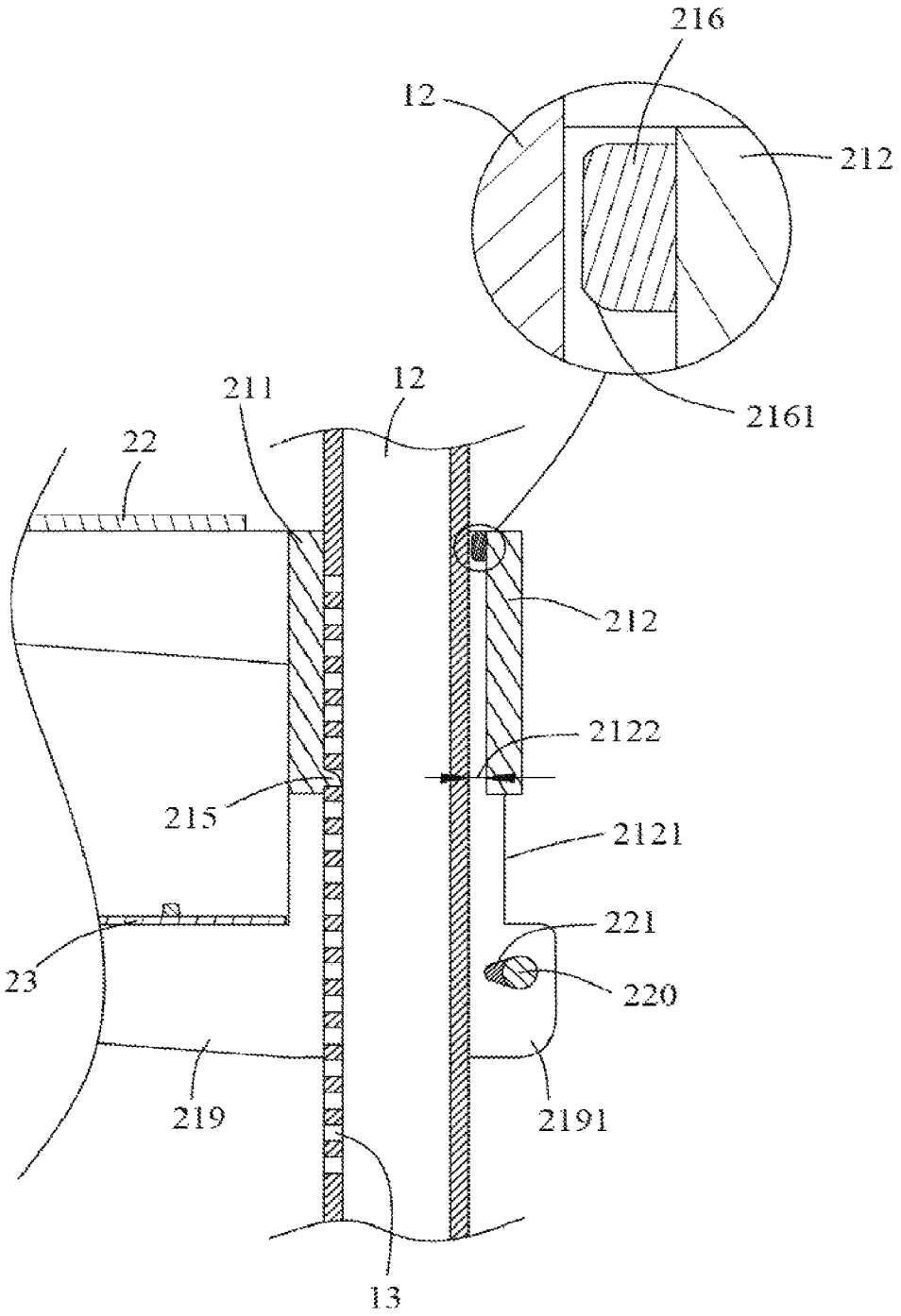
FIG. 3 is a cross-sectional diagram of the shelf before adjusting the height according to the first preferred embodiment of the present invention.
Figure 4:
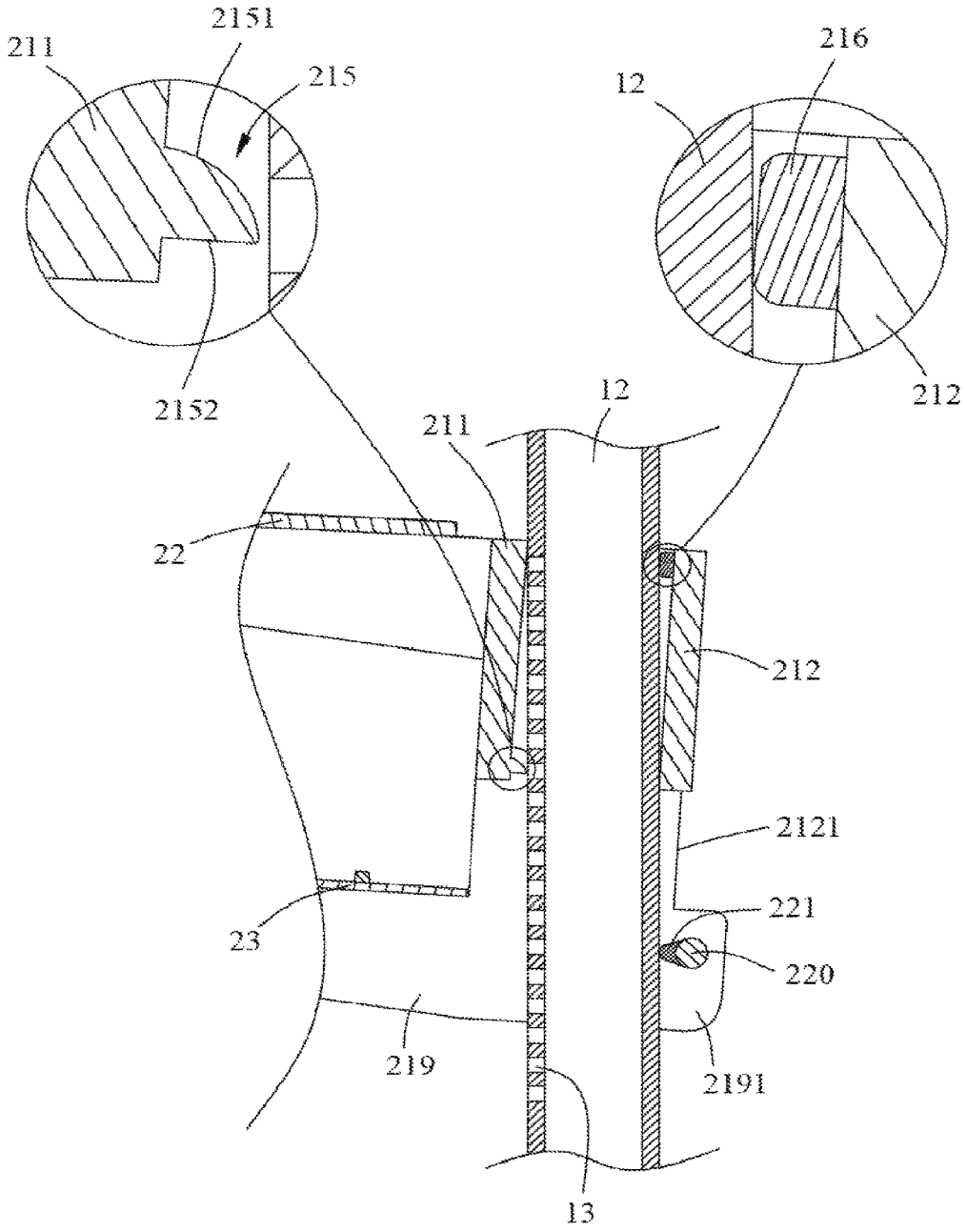
FIG. 4 is a cross-sectional diagram of the shelf after adjusting the height according to the first preferred embodiment of the present invention.

As shown in FIG. 3 and FIG. 4, with respect to the slots 13 of the column 12, a rear side of the front panel 211 of the frame 21 has an insert 215 protruding from the front panel 211, the insert 215 is protruded at a lower side of the middle of the rear side of the front panel 211, an upper side of the insert 215 is a cambered surface 2151, and a bottom side of the insert 215 is a flat surface 2152, the cambered surface 2151 of the insert 215 creates a space to allow the insert 215 to leave the slot 13, the cross-section of the insert 215 is rectangular, the shape of the cross-section of the insert 215 corresponds to the shape of the slots 13, when the insert 215 is tightly inserted into the slot 13 of the column 12, the rear side of the front panel 211 of the frame 21 will be attached to the front side of the column 12.

As shown in FIG. 3 and FIG. 4, with respect to the rear side of the column 12, there is a gap 2122 between a front side of the rear panel 212 of the frame 21 and the rear side of the column 12. A spacer 216 located within the gap 2122 is attached to an upper part of the front side of the rear panel 212 by screws, the spacer 216 is spaced apart from the rear side of the column 12, the spacer 216 is a rectangular column extending in a transverse direction from the left to the right of the height adjustable desk, a bottom of a front side of the spacer 216 forms a bevel 2161 tilted toward the rear panel 212, in which the bevel 2161 creates a space to allow the shelf 20 to be swung back-and-forth while the user applies force to drive the spacer 216 abutting against the rear side of the column 12. The position of the spacer 216 is relatively higher than the position of the insert 215, while the spacer 216 abuts against the rear side of the column 12 to be as a pivot of the frame 21, the gap 2122 is the space allowing the insert 215 to disengage from the slot 13.

Figure 5:
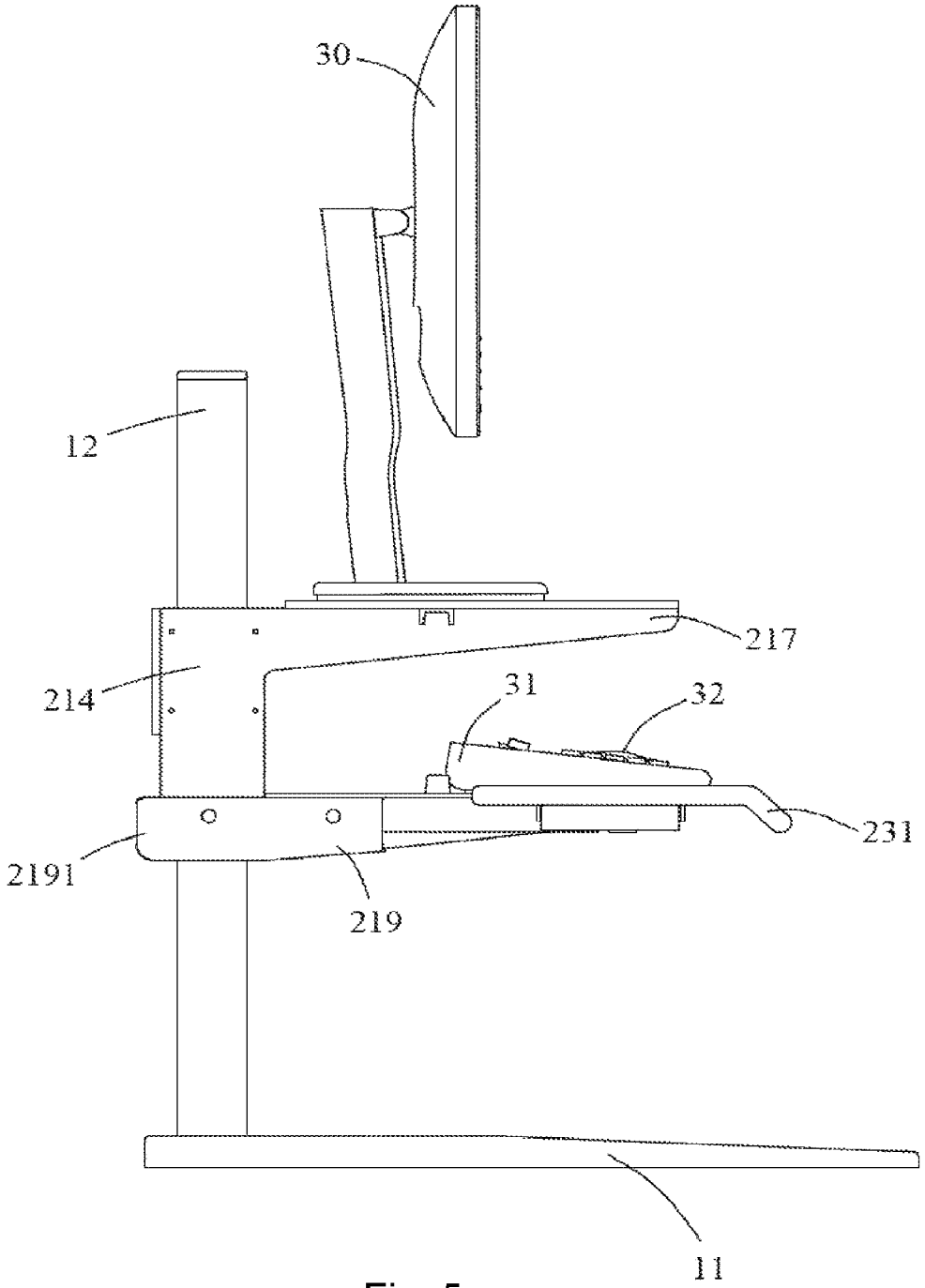
FIG. 5 is a right view of the first preferred embodiment of the present invention.

As shown in FIG. 2 and FIG. 5, each of the upper parts of the left panel 213 and the right panel 214 of the frame 21 has an extending arm 217 extending toward the front and being symmetrical to each other. The upper surfaces of the two extending arms 217 are flat. The frame 21 can further include a fixing beam 218 extended in a direction from the left to the right. The upper surface of the fixing beam 218 is a flat surface, and the fixing beam 218 is connected with and passed through each of the upper parts of the middle of the extending arms 217. The upper surface of the fixing arm 218 is aligned with the upper surfaces of the extending arms 217. The frame 21 can further include two support arms 219 extending toward the front and located at the right side and the left side of the frame 21, respectively. The support arms 219 are fixed on the bottoms of the left panel 213 and the right panel 214 by screws. Each of the two support arms 219 has a protrusion 2191 protruding toward the rear and being parallel to each other. The heights of the upper surfaces of the two support arms 219 are relatively lower than the height of the bottom edge of the rear panel 212. In order to further strengthen the structural stability of the two support arms 219, a connecting rod 220 is connected between the two protrusions 2191, the connecting rod is a cylindrical column extending a transverse direction, namely extending from the left to right. The front of the connecting rod 220 is further attached with a bumper 221. The bumper 221 is spaced apart from the rear side of the column 12, and the bumper 221 is a rectangular column extending in a transverse direction. While moving the frame 21, the bumper 221 can prevent direct collision of the rear side of the column 12 by the connecting rod 220, thereby preventing damages of the column 12 and the connecting rod 220.

As shown in FIG. 1 and FIG. 2, the shelf 20 includes the upper desk top 22 and the lower desk top 23, the height of the upper desk top 22 is higher than the lower desk top 23, the space between the upper desk top 22 and the lower desk top 23 is greater than 15 cm, thereby having enough space for user to operate the keyboard and the mouse placed on the lower desk 23 comfortably. The upper desk top 22 is in a semicircle shape with the flat side facing toward the front, the upper desk top 22 is disposed at the upper surfaces of the extending arms 217 and the fixing beam 218, which are all located at the upper part of the frame 21, where the upper desk top 22 can be fixed at the upper surfaces between a front end and a rear end of each extending arm 217, as well as the upper surface of a left end and a right end of the fixing beam 218, by screws in a symmetrical manner. The upper desk top 22 is made of transparent material, where the user may observe the objects located at the lower desk top 23 through the upper desk top 22 by his naked eyes. The lower desk top 23 is in a semicircle shape with the edge of the flat side extending toward the front with a downward slope. The lower desk top 23 is disposed on the upper surfaces of the support arms 219 located at a bottom of the frame 21, where the lower desk top 23 is fixed on the upper surfaces of the two support arms 219 by screws. Moreover, two handles 231 are also provided and assembled with the left and right sides of the lower desk top 23, respectively. Each of the handles 231 is a rectangular bar extending toward the front and sloping downward along the flat side of the lower desk top 23, the handles 231 are being set symmetrically. Three fixing blocks 232 disposed at the rear part of the upper surface of the lower desk top 23 are provided and being evenly spaced in a transverse direction, i.e. from the left to the right or the opposite. The fixing blocks 231 are to be used to prevent objects dropping to the ground while the shelf 20 is being adjusted.

Figure 6:
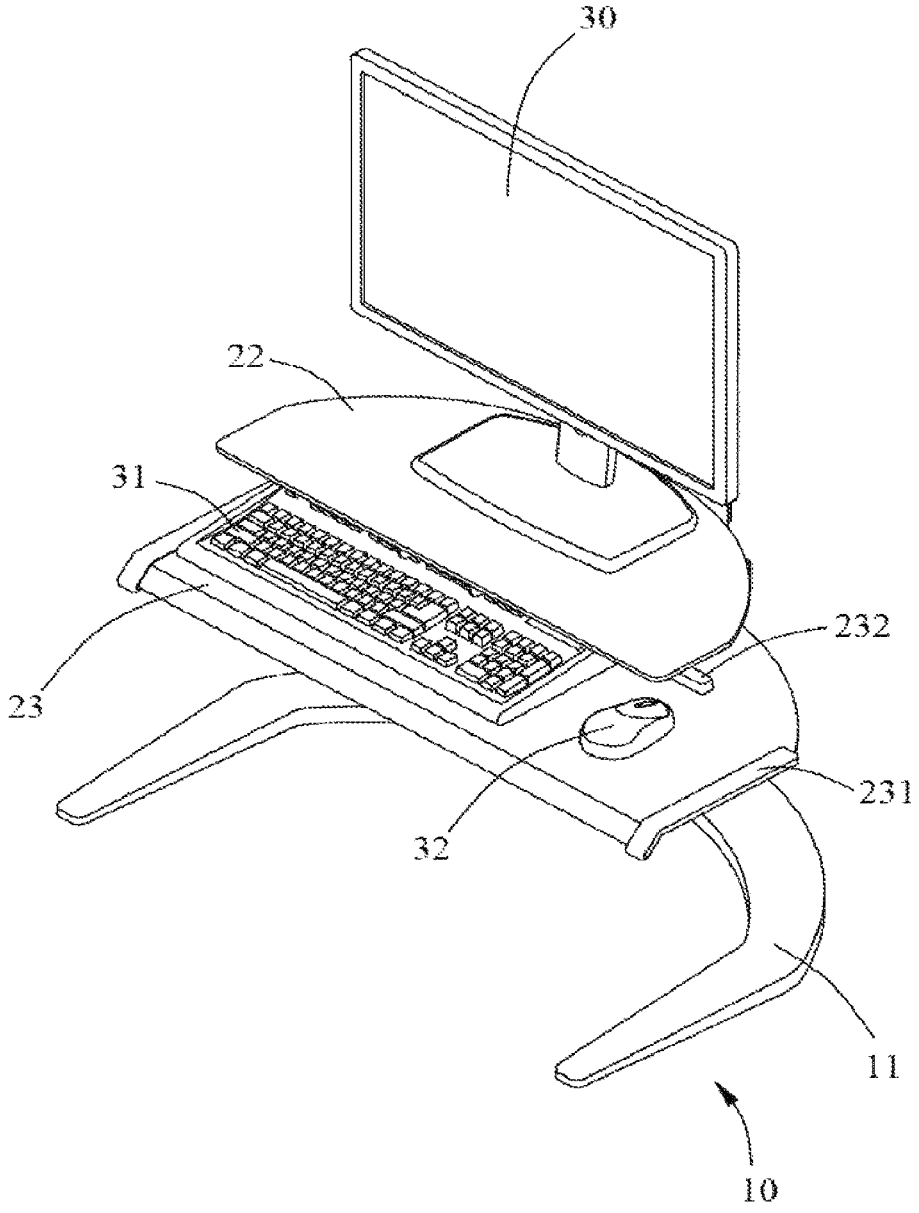
FIG. 6 is a schematic diagram of the shelf according to a second preferred embodiment of the present invention.

As shown in FIG. 6, the main difference of the second preferred embodiment comparing to the first preferred embodiment is that the upper desk top 22 is made of opaque materials. The structures of the second preferred embodiment are identical to the first preferred embodiment and will not be repeated here.

While using the height adjustable desk of the present invention, as shown in FIG. 1, FIG. 3 and FIG. 4, the user can grip the handles 231 of the lower desk top 23 and to slightly pull the handles 231 toward himself in parallel by his hands. Therefore, the shelf 20 can move toward the front relative to the column 12, and with respect to the front side of the column 12, the front panel 211 of the frame 21 moves forward away from the flout side of the column 12, the insert 215 moves forward as well but still remains in the slot 13, the spacer 216 on the rear panel 212 moves forward relative to the rear side of the column 12 and abuts against the rear side of the column 12 so as to be a pivot while the frame 21 moves. By using the spacer 216 as a pivot, the way the user applies force to the shelf is restrained; the user applies force to the handles 231 upwardly and in a direction toward the user himself, the bottom of the frame 21 will then be swung forward and upwardly as the top end of the rear panel 212 does not move with respect to the rear side of the column 12 due to the spacer 216 disposed there as a static pivot, the gap 2122 provides a space to allow the rear panel 212 of the frame 21 to move, the rest of the part of the rear panel 212 except the vicinity around the top end swings forward and upwardly within the gap 2122, the bottom edge of the rear panel 212 abuts against the rear side of the column 12, the insert 215 on the front panel 211 moves forward and upwardly and finally releases from the slot 13. More particularly, the frame 21 swings forward and upwardly and drives the support arms 219 and the connecting rod 220 connected between the protrusions 2191 of the support arms 219 to be swung forward and upwardly. As a result, the bumper 221 of the front side of the connecting rod 220 is also swung forward and upwardly to be abutted against the rear side of the column 12, thereby preventing damages caused by direct collision between the column 12 and the connecting rod 220.

The shelf 20 can then be freely moved up or down. While the user intend to adjust the shelf 20 upwardly, the user grips and lifts the handles 231 driving the shelf 20 to be slid upwardly along the column 12 to one of the slots 13 located at the ideal height determined by the user. Next, while the user applies force to the handles 231 away from himself in parallel. The shelf 20 moves backward with respect to the column 12, the front panel 211 moves backward with respect to the front side of the column 12, the rear side of the front panel 211 will then be attached to the front side of the column 12, the insert 215 of the front panel 211 moves backward, the insert 215 embeds into the slot 13, the spacer 216 of the rear panel 212 moves away from the rear side of the column 12, the gap 2122 between the front side of the rear panel 212 and the rear side of the column 12 now returns to normal, the bottom part of the frame 21 moves backward, thereby driving the two support arms 219 to be moved backward as well, the connecting rod 220 between the two protrusions 2191 and the bumper 221 at the front side of the connecting rod 220 moves backward and away from the rear side of the column 12.

While operating the height adjustable desk of the present invention, and if the handles 231 of the lower desk top 23 slip from the user's hands accidentally due to lost of attention or wet hands, the shelf 20 will not be dropped because of the shape and the height of the spacer 216. If the user's hands are suddenly loosen, the frame 21, the upper desk top 22 and the lower desk top 23 will applies a downward force due to gravity because of the interval between the force bearing point of the shelf 20 and the pivot provided by the spacer 216 of the frame 21, the shelf 20 is rotated by a rotational moment facing downwardly and in a direction close to the column 12, thereby driving the insert 215 of the frame 21 of the shelf 20 rotates downwardly and in a direction close to the column 12, and inserting the insert 215 into the slot 13. As a result, the shelf 20 still remains on the column 12 without causing harm to the user.

The advantages of the present invention are worth concluding as follows:

1. The bumper of the present invention can prevent the connecting rod of the frame colliding to the rear side of the column of the base, which possibly causes damages on the connecting rod and the column, when improper force is applied by the user while in use.

2. The upper desk top of the present invention can be made of transparent material, therefore when the user intends to grab the object placed on the lower desk top, the location of the object on the lower desk top may be directly observed by the user's naked eyes by seeing through the upper desk top.

3. The fixing blocks on the lower desk top may prevent dropping the objects placed on the lower desk top to the ground while lifting or lowering the height adjustable desk.

The description of the invention including its applications and advantages as set forth herein is illustrative and is not intended to limit the scope of the invention, which is set forth in the claims. Variations and modifications of the embodiments disclosed herein are possible, and practical alternatives to and equivalents of the various elements of the embodiments would be understood to those of ordinary skill in the art upon study of this patent document.

What is claimed is:

1. A height-adjustable desk, comprising:

a base, having a support, a middle portion of a rear side of the support having a column disposed thereon and being upright, a front side of the column having a plurality of slots, the slots being spaced along the column; and a shelf, having a frame, an upper desk top and a lower desk top, the frame disposed on and moveably surrounding the column, the frame having an insert corresponding to the slots, the insert configured to be inserted into one of the slots, the upper desk top located at the frame, the lower desk top located at the frame lower than the upper desk top, the frame having a front side and a rear side with a front panel and a rear panel disposed thereon respectively, and having a left side and a right side with a left panel and a right panel disposed thereon respectively;

the interval between the front panel and the rear panel greater than the width between the front side and the rear side of the column, a rear side of the front panel of the frame which is relative to the front side of column having the insert, an upper side of the insert being a cambered surface and a bottom side of the insert being a flat surface, the rear side of the front panel configured to be attached to the front side of the column the rear side of the column and a front side of the rear panel of the frame which is relative to the rear side of the column defining a gap, the front side of the rear panel of the frame having a spacer located within the gap and attached to an upper part of the front side of the rear panel, a bottom edge of a front side of the spacer forming a bevel, the location of the spacer relatively higher than the insert, each of an upper part of the left panel and an upper part of the right panel of the frame having an extended arm extending toward the front and being symmetrical to each other, each of a bottom of the left panel and a bottom of the right panel having a support arm extending toward the front and wherein the upper desk top is located at the front of an upper part of the frame, the upper desk top is placed on two respective upper surfaces of the two extending arms, the lower desk top is located at the front of a lower part of the frame, and the lower desk top is placed on two respective upper surfaces of the two support arms.

2. The height-adjustable desk as claimed in claim 1, wherein the height of a bottom edge of the rear panel is relatively higher than the height of a bottom edge of the left panel and the height of a bottom edge of the right panel, an opening is formed at a lower part of the rear panel, the heights of the upper surfaces of the two support, arms are relatively lower than the height of the bottom edge of the rear panel, each of the two support arms has a protrusion protruding toward the rear and being parallel to each other, a connecting rod is connected between the two protrusions, and the front of the connecting rod is attached with a bumper.

3. The height-adjustable desk as claimed in claim 1, wherein the upper desk top is a transparent desk top.

4. The height-adjustable desk as claimed in claim 1, further comprising a plurality of fixing blocks being evenly separated in a direction from the left to the right on a rear part of an upper surface of the lower desk top.

5. The height-adjustable desk as claimed in claim 1, wherein each of a left side and a right side of the lower desk top has a handle.

6. The height-adjustable desk as claimed in claim 1, further comprising a fixing beam extending in a direction from the left to the right, wherein the fixing beam is connected with and passed through each of the upper part of the middle of the extending arms.

7. The height-adjustable desk as claimed in claim 1, further comprising a plurality of fixing blocks being evenly separated in a direction from the left to the right on a rear part of an upper surface of the lower desk top.

8. The height-adjustable desk as claimed in claim 1, wherein the upper desk top is a transparent desk top.

9. The height-adjustable desk as claimed in claim 8, further comprising a plurality of fixing blocks being evenly separated in a direction from the left to the right on a rear part of an upper surface of the lower desk top.

* * * * *